United States Patent [19]

Jelsness-Larsen

[11] 3,957,265

[45] May 18, 1976

[54] APPARATUS FOR STRAIGHTENING STACKS OF SHEET MATERIAL

[76] Inventor: Gunnar Jelsness-Larsen, St. Mariegate 39, 1700 Sarpsborg, Norway

[22] Filed: Apr. 15, 1974

[21] Appl. No.: 460,892

[30] Foreign Application Priority Data

Apr. 13, 1973 Norway ..... 1563/73

[52] U.S. Cl. ..... 271/213
[51] Int. Cl.[2] ..... B65H 31/34
[58] Field of Search ..... 271/210, 213; 214/310

[56] References Cited

UNITED STATES PATENTS 3,418,725 12/1968 Ruud ..... 271/210
3,656,743 4/1972 Ruud ..... 271/210
3,756,436 9/1973 Lingg ..... 214/310

*Primary Examiner*—John J. Love
*Assistant Examiner*—Robert Saifer
*Attorney, Agent, or Firm*—Stevens, Davis, Miller & Mosher

[57] ABSTRACT

An apparatus for straightening stacks of sheet material which includes a base on which there is rotatably mounted a device for supporting a stack of disposed sheets in an initial horizontal position and a position in which the stack is resting on a support with the sheets in vertical position, a vibrator for straightening the vertically disposed sheets against the support and against a stacking strip, and lifting bars for raising the vertical sheets from a first position below the support to a position above the support plane and back to the first position.

8 Claims, 2 Drawing Figures

APPARATUS FOR STRAIGHTENING STACKS OF SHEET MATERIAL

Figure 1:
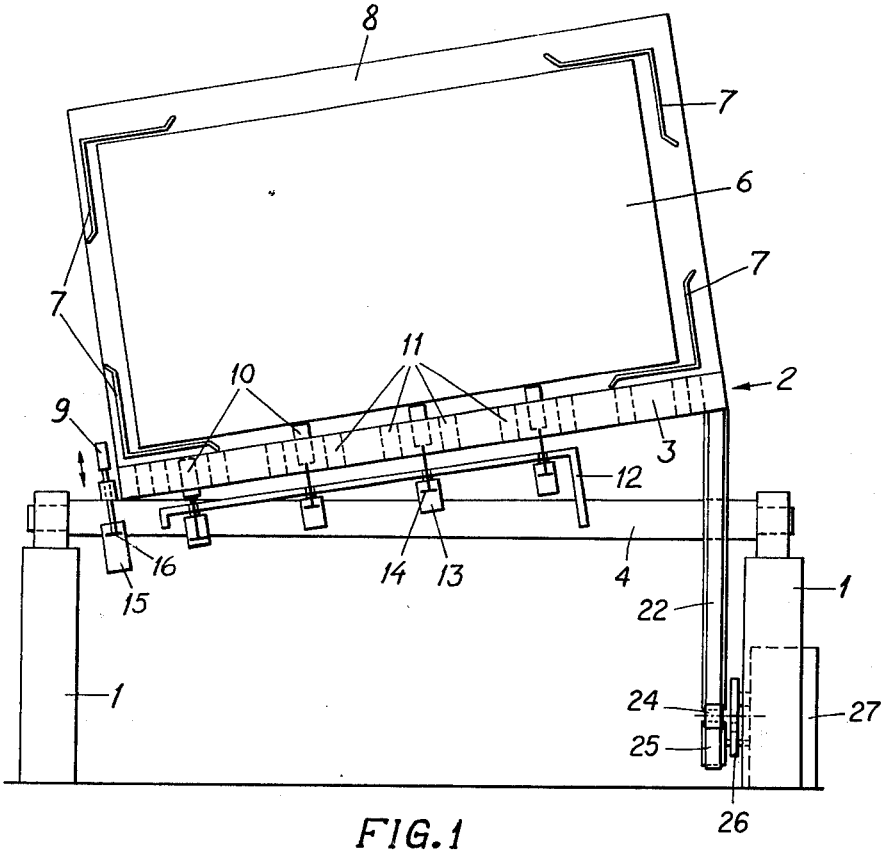

This invention relates to an apparatus for straightening stacks of sheet material and includes a base on which there is rotatably mounted a device for supporting, in an initial position thereof, a stack of essentially horizontally disposed sheets, and being operable to be rotated, with the stack placed thereon, from said initial position to a position in which the stack is resting on a support with the sheets in vertical position, and vibrating means for straightening the vertically disposed sheets against the support and against an abutment edge in the form of a so-called stacking strip.

Devices of this type are constructed for handling and suitable straightening of stacks of cardboard or paper sheets for printing in different types of printing machines. These devices may also be provided with means for injecting air into stacks of printed sheets, as these stacks must be vented and the drying powder which has been applied during the printing process, must be removed. The sheet stacks arriving at such an apparatus in order to be subjected to ventilation and straightening, are supported by loading stools. When the sheets are stacked on the loading stool after having gone through a printing process, the sheets are generally available in a number of sub-stacks, or partial stacks of which each is supported by intermediate discs which in turn is supported by so-called corner supports or segments which are placed or located at the corners of each partial stack. The background of this stacking method will be briefly described in the following.

When freshly printed sheets emerge from the printing press, there is a risk of color offset as long as the printing color is not quite dry. In order to avoid color offset there is applied a drying powder which serves to keep the sheets apart. In spite of the use of drying powder there is a risk of color offset when the freshly printed sheets are arranged in high stacks. By increasing height and weight of the stack especially the lowest sheets in the stack will be subjected to risk of offset. In order to avoid this problem, the so-called corner supports and intermediate discs are utilized. Dependent on the kind of printing work and the quality of the paper or cardboard, unloading or relief discs are inserted into the stack as the sheets are delivered from the printing machine. The sheets are then laid out or arranged on the loading stool in a certain height, whereafter corner supports being slightly higher than the stack itself, are inserted at the four corners of the stack. At the top of these four corner supports there is than placed an intermediate disc or relief disc which will then constitute a bridge above the underlying stack. On the top of the inserted relief disc is then arranged another stack which in turn is provided with corner supports and new intermediate discs and so on.

The process of removing the inserted corner supports and intermediate discs has since long represented a problem within the printing-office field. Previously this has been done manually by restacking the sheets on another loading stool. Also when using stack turners of straightening and venting devices of the type described above, it is a problem to remove corner supports and intermediate discs. By application of such devices on sheet stacks which are stacked as described above, problems arise as the sheets will rest on the inserted corner supports when the device or apparatus is in working position, i.e. when the stack is rotated so that the sheets are vertically disposed. The stack of cardborad or paper sheets will then rest on the corner supports which in most cases have such a form that they are difficult to withdraw from the apparatus. The commonly existing corner supports consist of an angled plate having bent outer edges in order to achieve maximized rigidity. These are especially difficult to remove from a stack which is placed in a straightening or venting apparatus, but also corner supports without bent outer edges are very difficult to remove because of the weight of the stack resting on the underlying corner supports. The removal is also impeded by the stacking strip which is arranged in the apparatus and which is located in front of and blocks the withdrawal of one of the corner supports.

An object of the invention is to provide a means which enables ready removal of the corner supports from a stack which is placed in a straightening and venting apparatus.

This object is obtained, in accordance with the invention, in that an apparatus of the type set forth above, is provided with a lifting means capable of being raised from a first position below said suppport to a position above the support plane, for keeping the stack raised above the support, and being movable back to said first position in which it does not effect any lifting action, and means for lowereing said stacking strip to a position below said support plane.

Figure 2:
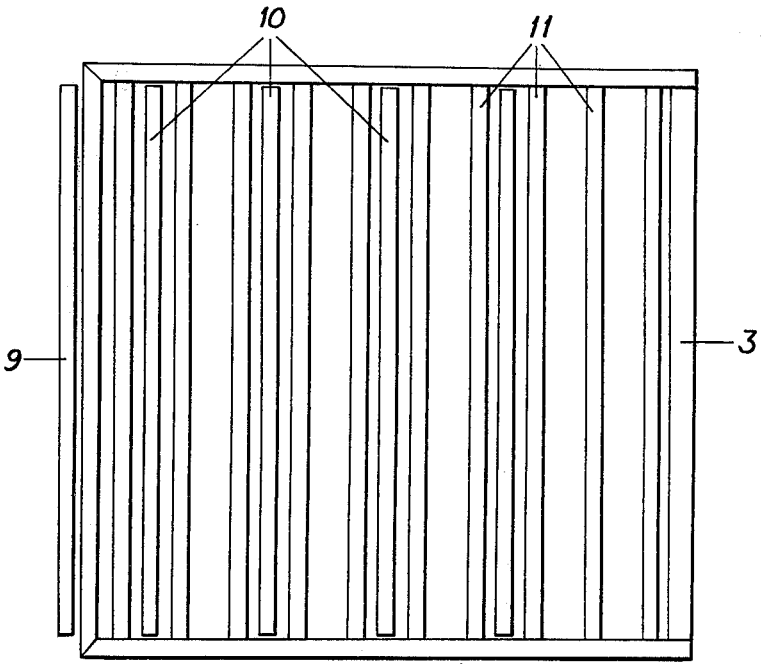

The above and other objects, features and advantages of the present invention will become more readily apparent from the following detailed description, reference being made to the appended drawings in which:

FIG. 1 is a schematic side elevation of a straightening and venting apparatus which is provided with a means according to the invention, and FIG. 2 is a schematic top view of the supporting table of the apparatus and a part of the lifting means according to the invention.

In FIG. 1 there is shown an apparatus or so-called cardboard venting machine of a construction which is previously known and which will therefore be only briefly described here. For a closer description of constructive details of this apparatus reference is hereby made to Norwegian Patent No. 128,954. The apparatus includes a base 1 on which there is rotatably mounted a supporting device 2. The supporting device comprises a supporting table or a frame 3 which in the shown position forms an angle with the horizontal plane. At its four corners the frame 3 is supported in a way not specifically shown, and below the frame there is further arranged a vibrating means (not shown) for vibration of the frame and a stack of cardboard or paper sheets placed on the frame. In the embodiment shown the supporting device 2 is rigidly mounted on an essentially horizontal shaft 4 which is rotatably mounted on the base 1. By means of a motorized rotating means the supporting device 2 with the support table 3 may be rotated 90° to each side from the position shown in the Figure. A steel segment 22 is attached to the device 2. Along the outer surface of this segment there is disposed a driving belt which at its ends is fixed to the device 2 and runs over a pair of idle wheels (only one of which is shown) and over a driving wheel 25. The driving wheel 25 is driven by way of a worm drive 26 by means of a motor 27 mounted on the base. At the inclined side edges of the support table 3 the supporting device 2 is provided with movable supporting plates (not shown) for lateral support of the sheet stack in the shown position and for the support of the stack when the stack, in the initial position of the machine (the supporting device rotated 90° relative to the position shown in the Figure), is placed with horizontally disposed sheets on one of said supporting plates. In this position the stack is supported by a transport loading stool and is as previously discussed, in the form of a number of partial stacks which are supported by intermediate discs and corner supports. When the supporting device 2, with the stack placed thereon, is rotated to the position shown in FIG. 1, the sheets are moved from horizontal to vertical position and the sheets and the intermediate discs of the stack are then supported in vertical position by the support table 3, whereby the undermost located corner supports are pressed against the support table because of the total weight of the stack. In FIG. 1 is shown how a partial stack 6 is surrounded by corner supports 7. Further there is shown an intermediate disc 8.

As in practice relatively large sheet formats may be involved and correspondingly large stacks, these will have a substantial weight. It is then obvious that it involves considerable problems to withdraw or pull out the undermost located corner supports when the stack is placed on the support table. In order to pull out these corner supports much strength is required, and even if the support should be withdrawable when the stack rests on the supports, this operaton may cause damage of the stack as well as of the support table. Moreover, at the lower edge of the support table there is arranged a stopping strip or so-called stacking strip 9 against which the sheets are to be straightened or aligned when the support table is put to vibration by means of said vibrating means. As this stacking strip is located above the support plane of the stack, it will block or prevent a direct withdrawal or extraction of the adjacent corner support. This causes additional problems by the removal of the corner supports.

By means of the device according to the invention the problem of removing the corner supports is solved. This is achieved by means of a lifting means which in the embodiment shown comprises a number of lifting beams 10 which are arranged in respective spaces between a number of longitudinal crossbars or struts 11 in the support table or frame 3 (see FIG. 2). The lifting beams 10 are adapted to be moved upwards between the struts of the support table, so that the sheet stack may be lifted or raised in its central porton which is without corner support, and so that the corner supports are not under pressure by the stack. For raising and lowering of the lifting beams relative to the supporting plane of the frame there is arranged a suitable control gear of operating device. In the embodiment shown the lifting beams 10 are supported on a rack 12 which are rigidly mounted on the shaft 4. The operating device here comprises a separate device for each lifting beam, and each device may e.g. comprise a cylinder 13 with a plunger 14 which is connected to a respective lifting beam. The plungers may be driven hydraulically or pneumatically and may be operated in common or individually by means of a driving source connected to the cylinders. The specific construction of this arrangement is of technical nature and is therefore not more specifically shown. Instead of using a pneumatic or hydraulic driving means, the lifting means may also be operated and controlled by means of electrical or mechanical devices. The lifting means are operable so that the stack is lifted or raised after it has been turned or rotated to vertical position of the sheet, or the construction may also be such that the lifting means are placed in its lifting position when the apparatus is in the initial position. The sheets in the stack will then fall down onto the raised lifting beams when the stack is turned to the position shown in FIG. 1, and after the corner supports have been removed the lifting beams may be lowered to a position where they do not effect any lifting action. In order to be able to adapt the device to different sheet formats, it is necessary that at least two lifting beams can act upon that part of the underside of the stack which is not covered by the corner supports. For this reason the lifting means will be provided with several lifting beams which may then be operated in dependence on the sheet format which is to be handled. The lifting beams which will positively hit or run against the corner supports by the handling of a little sheet format will then be disconnected by running of this special format. This may be simply done when the lifting beams are actuated by operating devices which may be individually activated.

As indicated in FIG. 1, the abutment edge or stacking strip 9 of the apparatus is also adapted to be able to be raised and lowered relative to the plane of the support table. In the embodiment shown the stacking strip is connected to a plunger 16 which is arranged in a cylinder 15 and which may be pneumatically or hydraulically operated. The movement of the stacking strip may be coordinated with the movement of the lifting beams, or the strip may be operated independent of the beams. The operation of the stacking strip may also be carried out by means of electrical or mechanical devices, or it may be operated manually. When the stacking strip 9 is lowered below the plane of the support table, and the lifting beams are simultaneously raised, the adjacent corner support can be directly pulled out from the stack.

It may also be advantageous that one or more of said lifting beams are designed as an alternative stacking strip which, when required, can undertake the function of the ordinary stacking strip 9. With a movable stacking strip arranged inwardly of the ordinary stacking strip 9, it will be possible to center a sheet stack on the loading stool in those cases where the sheet format is substantially less than the format or size of the loading stool. With two stacking strips, both the sheets and the loading stool may be straightened or aligned against the innermost stacking strip, whereafter the stacking strip may be lowered beneath the plane of the table, and the loading stool may subsequently be pulled relative to the sheet stack so that the latter will be situated in the middle of the loading stool. This may be advantageous by the further transport and handling of the stack.

I claim:

1. In an apparatus for straightening stacks of sheet material and including a base on which there is rotatably mounted a device for supporting, in an initial position thereof, a stack of horizontally disposed sheets, and being operable to be rotated, with the stack placed thereon, from said initial position to a position in which the stack is resting on a support with the sheets in essentially vertical position and against an abutment edge in the form of a stacking strip, the improvement comprising a lifting device which by means of an operating device is operable to be raised from an initial position below the support plane of the support to a position above the support in order to keep the sheet stack raised above the support plane, and being operable to be lowered to said initial position wherein it does not effect any lifting action, and means for lowering said stacking strip to a position below said support plane.

2. An apparatus according to claim 1, wherein said support comprises a frame with parallel, spaced apart struts extending transversely to the sheets of the stack, and wherein the lifting device includes a number of lifting beams arranged in respective spaces between said struts, and individually operable operating devices are provided for raising and lowering of associated lifting beams.

3. In an apparatus for straightening stacks of sheet material and including a base on which there is rotatably mounted a device for supporting, in an initial position thereof, a stack of horizontally disposed sheets, and being operable to be rotated from said initial position to a position in which the stack is resting on a support with the sheets in vertical position and against an abutment edge in the form of a stacking strip, the improvement comprising a lifting device in the form of a number of lifting beams extending transversely to the sheets, and an operating device by means of which the lifting beams can be raised from an inoperative position below the support plane of the support to a raised position wherein the entire sheet stack is kept raised above the support, and lowered to said inoperative position wherein the beams do not effect any lifting action, one or more of the lifting beams being provided with separate operating devices for individual operation of the associated lifting beams.

4. An apparatus according to claim 3, wherein the operating devices include cylinders with pistons which are connected to the respective lifting beams.

5. An apparatus according to claim 4, wherein said pistons are pneumatically operated.

6. An apparatus according to claim 4, wherein said pistons are hydraulically operated.

7. An apparatus according to claim 3, wherein said stacking strip is operable to be raised above or lowered below the support plane of the support by means of an associated operating device.

8. An apparatus according to claim 3, wherein one or more of said lifting beams are constructed as an alternative stacking strip capable of undertaking the function of the ordinary stacking strip.

* * * * *